US005081781A

United States Patent [19]

Kanyuck et al.

[11] Patent Number: 5,081,781

[45] Date of Patent: Jan. 21, 1992

[54] GUN LOADING DEVICE

[76] Inventors: Emil L. Kanyuck, 925 Pleasant Dr., York Haven, Pa. 17370; Carl J. Winters, Jr., R.D. #6, Box 160, Red Lion, Pa. 17356

[21] Appl. No.: 657,664

[22] Filed: Feb. 19, 1991

[51] Int. Cl.[5] ..... F41C 27/00

[52] U.S. Cl. ..... 42/90

[58] Field of Search ..... 42/90

[56] References Cited

U.S. PATENT DOCUMENTS

| | | | |
|---|---|---|---|
| 11,174 | 6/1854 | Peavey | 42/90 |
| 163,404 | 5/1875 | Phillips | 42/90 |
| 184,079 | 11/1876 | Hovis | 42/90 |
| 4,229,897 | 10/1980 | Snowden | 42/90 |
| 4,373,285 | 2/1983 | Grout et al. | 42/90 |
| 4,442,620 | 4/1984 | Drake et al. | 42/90 |
| 4,536,983 | 8/1985 | Fry | 42/90 |
| 4,550,517 | 11/1985 | Mansfield | 42/90 |
| 4,571,873 | 2/1986 | Houk | 42/90 |
| 4,601,125 | 7/1986 | Curtis | 42/90 |
| 4,862,623 | 9/1989 | Delap et al. | 42/90 |

*Primary Examiner*—Charles T. Jordan
*Attorney, Agent, or Firm*—C. Hercus Just

[57] ABSTRACT

A gun-loading device comprising a base member having a socket to receive the muzzle of a gun to be loaded with a charge of powder and/or a bullet, a storage cylinder provided with a plurality of bores in a circular pattern which receive such charges and is rotatable about a fixed axis of the base member, a top or upper inlet member has an opening through which a plunger is perpendicularly slideable to push, sequentially, the charges of powder in the bores through a discharge opening in the base member, and a non-twistable connecting member extends between the base and inlet members to connect them together with the rotatable cylinder being rotatable therebetween. Quick-releasable latch members preferably are used to secure the connecting member respectively to the base and inlet members, as well as render the elements readily disassembled for cleaning, and the preferred material from which the components of the device are formed is synthetic resin, such as "LEXAN" or A.B.F.

8 Claims, 3 Drawing Sheets

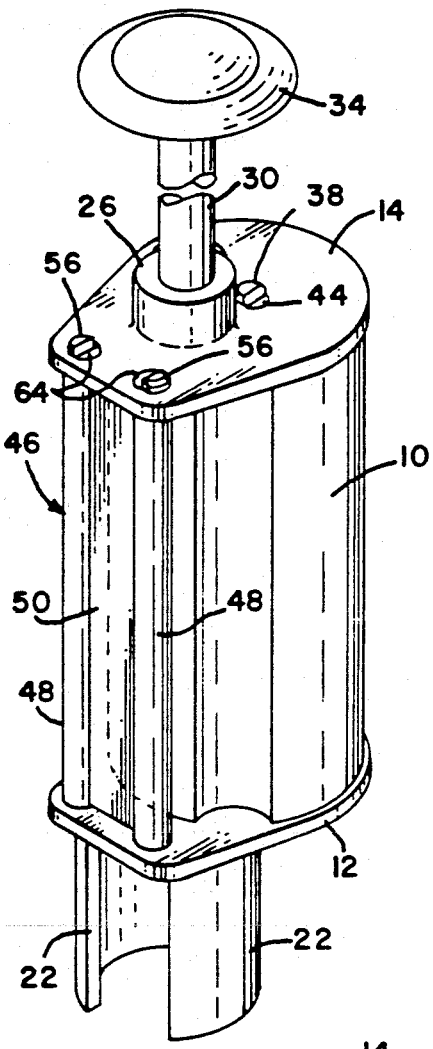
FIG. 2
FIG. 7
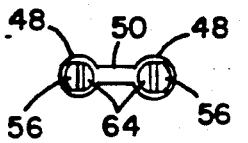
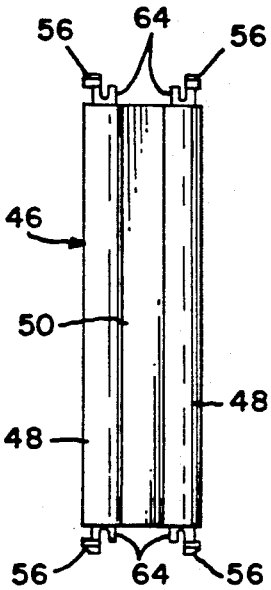
FIG. 6
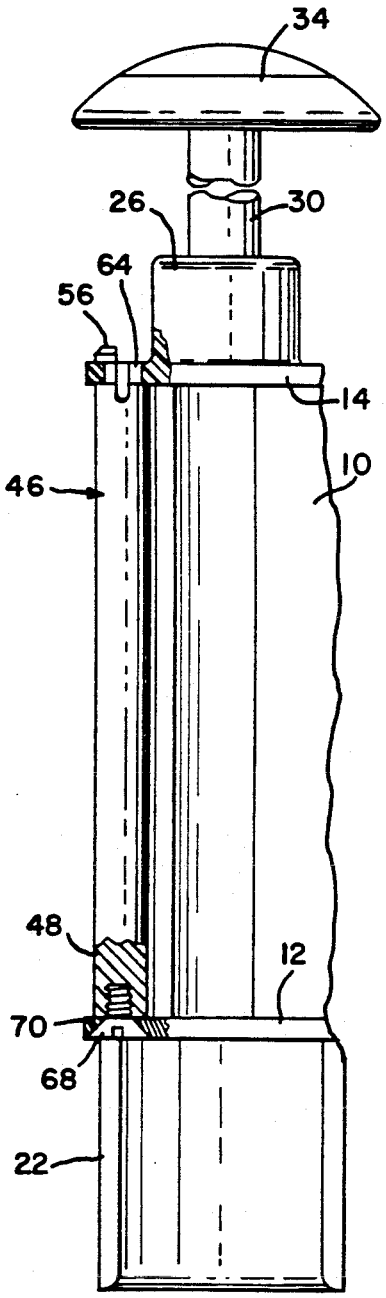
FIG. 8
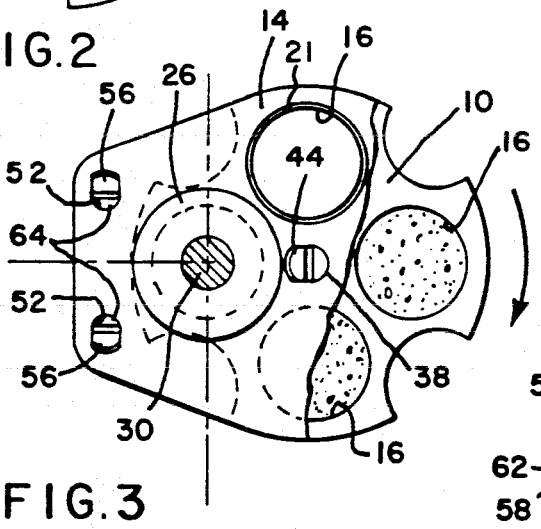
FIG. 3
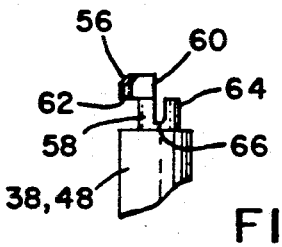
FIG. 9

GUN LOADING DEVICE

BACKGROUND OF THE INVENTION

This invention comprises a device for loading guns with charges of powder and/or bullets or balls and the main purpose of the device is to facilitate such loading with accuracy and dispatch, coupled with ready cleanability of the device.

In pioneer times, the principal accouterments for loading guns or rifles was a powder horn, a bullet pouch and a ramrod. Such items have not entirely passed into oblivion since there are certain buffs who prefer to use these relatively crude items. Thus, while shooting muzzle-loading guns and rifles is still a popular sport, the participants largely prefer to use more sophisticated equipment when participating in muzzle-loading gun activities. The present invention is directed toward the latter type of equipment.

The development of convenient devices for loading muzzle-loading guns and rifles is a field of activity which goes back well into the previous century. For example, U.S. Pat. No. 163,404 to O. D. Phillips, granted in 1875, comprises a multi-bore rotatable cylinder rotatable upon a base having a socket to receive the muzzle of a gun or rifle and an offset plunger discharges the powder from the bores into the muzzle of the gun. The patent to C. W. Hovis, U.S. Pat. No. 184,079, issued in 1876, also is somewhat similar to the foregoing patent except that no plunger is included.

Within the past ten or twelve years there seems to have been renewed activity in developing more modern types of loaders for guns and rifles as is evident from the following patents:

U.S. Pat. No. 4,229,897—Snowden—1980,
U.S. Pat. No. 4,442,620—Drake et al—1984,
U.S. Pat. No. 4,550,517—Mansfield—1985,
U S. Pat. No. 4,571,873—Houk—1986,
U.S. Pat. No. 4,601,125—Curtis—1986,
U.S. Pat. No. 4,862,623—Delap et al—1989.

SUMMARY OF THE INVENTION

It is among the several objects of the invention to provide a gun or rifle-loading device which can be made accurately and relatively inexpensively by being manufactured, preferably, by molding the components from synthetic relatively rigid but at least slightly flexible synthetic resin, such as "LEXAN" or A.B.F powdered resin which automatically provides means for forming small slightly bendable latch members which secure the components in quickly assembled and disassembled condition.

The principal reason for manufacturing the device from readily connected components is that they can readily be disassembled to render the components easily cleanable to remove any powder adhering thereto in view of the fact that powder is subject to absorbing atmospheric moisture and damp powder has a deleterious affect on surfaces of substances to which it adheres.

A further object is to simplify the construction of the device so that it can be formed from a minimum of components which are so designed and constructed with short rods extending between base and top inlet members which are connected by said aforementioned latch members, the rod structures being such that they render the assembly relatively incapable of being skewed or twisted, notwithstanding such rod construction.

The foregoing and other objects and advantages of the present invention will be apparent to those skilled in the art from the description which follows:

BRIEF DESCRIPTION OF THE DRAWINGS

FIG. 2 is an assembled perspective view of the gun-loading device.

FIG. 3 is a top plan view of the device as shown in FIG. 2 with a portion of the upper inlet member broken away to show details of elements below the same.

FIG. 6 is a vertical elevation of a non-twistable connecting member, otherwise shown in the exploded view of FIG. 1, as well as in FIG. 2.

FIG. 7 is a top plan view of the elements shown in FIG. 6.

FIG. 8 is a fragmentary vertical view, partly in section, illustrating an alternate arrangement of attaching means for certain of the elements of the device.

FIG. 9 is a fragmentary side elevation of the latching means commonly employed on one or both ends of the rod members mounted between the base and top inlet members.

DETAILED DESCRIPTION OF THE PREFERRED EMBODIMENTS OF THE INVENTION

Figure 1:
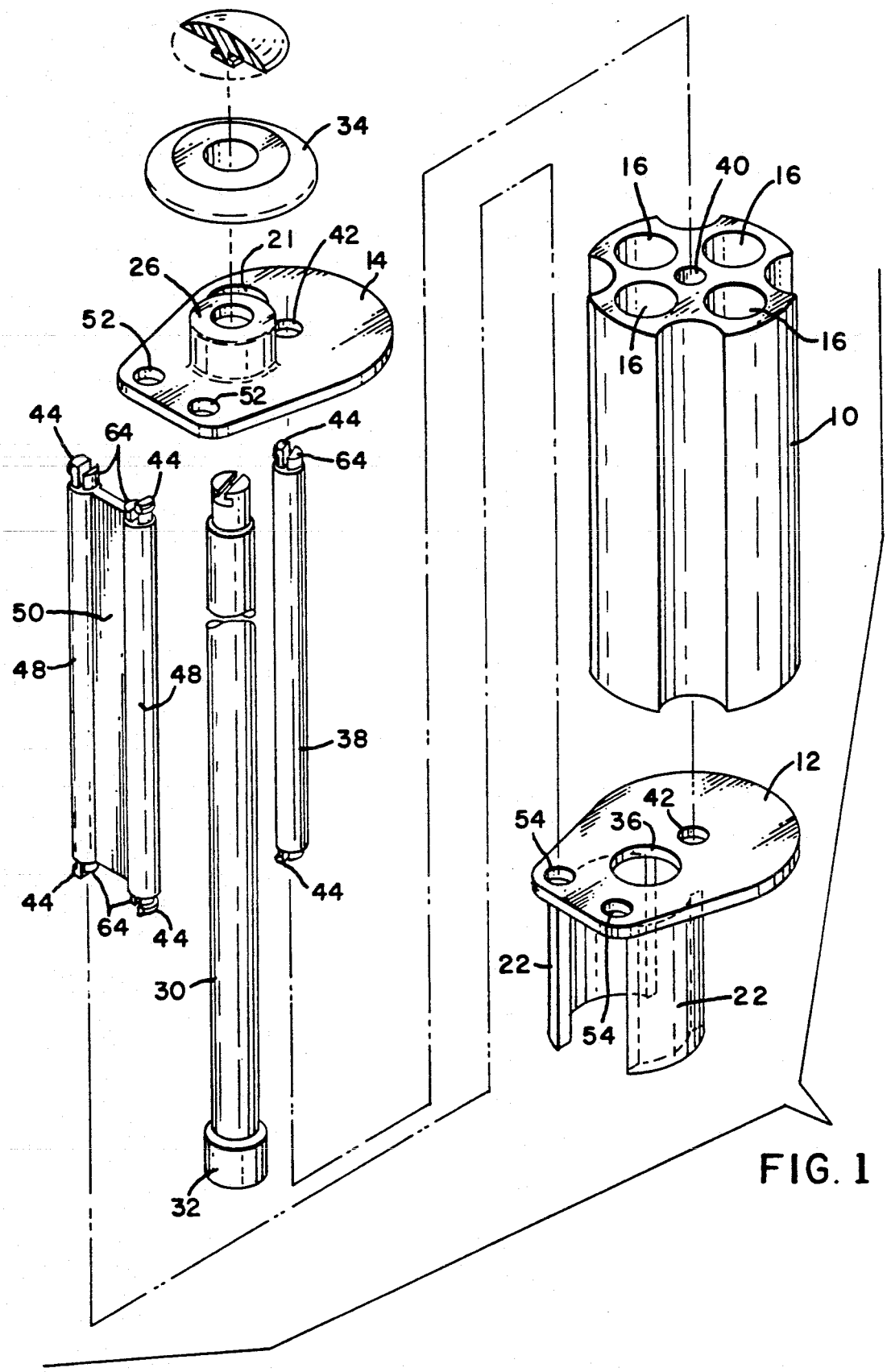
FIG. 1 is an exploded view, showing all elements of the gun-loading device comprising the present invention, the elements being shown in the sequence in which they appear when disassembled.
Figure 4:
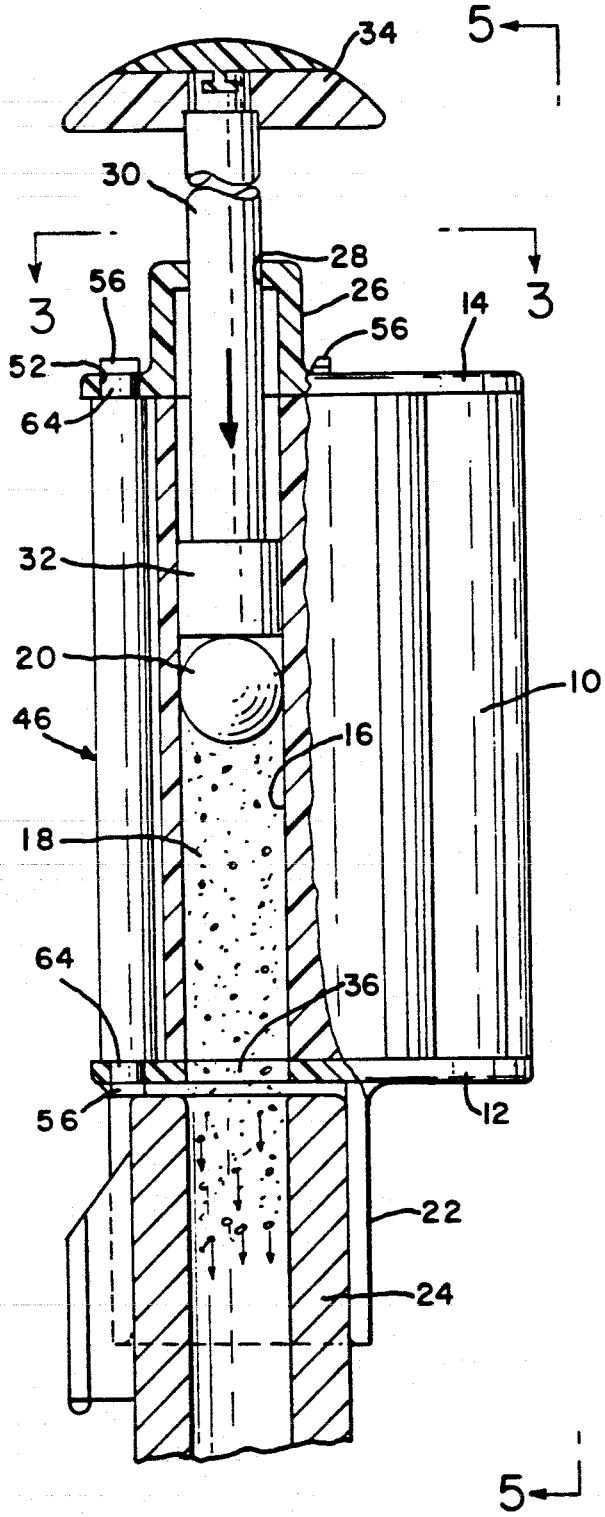
FIG. 4 is a partial vertically-sectioned view of the assembled device shown in FIG. 2 but illustrating the same in operative position upon a fragmentarily-shown upper end of the muzzle of a gun.

Referring especially to FIGS. 1, 2 and 4, it will be seen that the present invention of a gun-loading device comprises a cylinder 10, rotatably positioned between a lower base member 12 and an upper inlet member 14. As best seen from FIGS. 1 and 3, the cylinder 10 is provided with a plurality of parallel bores 16, which each are adapted to receive preferably measured charges of powder 18, see FIG. 4, and/or a bullet or ball 20. One popular example of ball used by shooters of muzzle-loading rifles and guns is sold under the trademark "Maxiball". These are constructed in such a way that they have a coating which requires no patch, as is customarily used in muzzle-loading guns or rifles of conventional type. Inlet member 14 is provided with a filling opening 21 through which said charges of powder and balls are loaded into the bores 16, successively, as clearly shown in FIG. 3. Said opening preferably is slightly greater in diameter than the bores 16 which register with opening 21 as the cylinder 10 is rotated. as described hereinafter.

Base member 12 is provided with a pair of depending elements 22, which are arcuate and comprise a socket which receives the muzzle end 24 of a gun or rifle, which is shown in fragmentary sectioned view in FIG. 4. To eject the powder charge 18 and bullet or ball 20 sequentially from the bore 16 of the cylinder 10, the upper inlet member 14 is provided with a cuplike extension 26, having a bearing opening 28 in the upper end thereof through which a discharge plunger 30 extends. The lower, inner end of the plunger 30 has a piston 32 mounted thereon, which actually engages the ball 20 and that, in turn, engages the powder charge 18. The upper end of plunger 30 is provided with a push-button 34, which is integrally secured to the upper end of the plunger 30. To effect discharge of the material in each of the bores 16, the base member 12 is provided with a discharge opening 36 through which the powder and ball pass incident to being received in the upper end of the muzzle 24 of the gun.

To maintain the above-described elements in assembled relationship, the present invention employs a plurality of similar lengths of relatively short rods. One such rod 38 is a spindle or axle that extends through a central bore 40 in the cylinder 10. The lower base member 12 and upper inlet member 14 respectively have holes or bores 42 therein, which respectively receive one of the opposite ends of rod 38, and especially the latch member 44 respectively on opposite ends of rod 38.

In order to stabilize cylinder 10 and base member 12 with respect to each other and to prevent relative twisting therebetween along the vertical axis, the present invention provides a compound non-twistable connecting member 46, which is best shown in FIGS. 6 and 7 and it will be seen in said figures that said connecting member actually comprises a pair of rods 48 which are integrally-secured to opposite edges of a web member 50, thus providing an effective non-twistable element. The opposite ends thereof extend respectively through openings 52 in the inlet member 14 and openings 54 in the base member 12, said openings being best shown in FIG. 1.

To facilitate the assembly, and more importantly, to facilitate the disassembly of the various elements, especially to effect general cleaning thereof and removal of remaining powder grains or the like, the opposite ends of the pivot rod 38 and connected pair of rods 48 comprising the non-twistable connecting member 46, all of which are the same length, are provided with latch members, best shown in detail in FIG. 9, but also in clear vertical plan view in FIG. 6.

At this point in the description, it should be mentioned that the preferred material from which substantially all, if not all, of the components of the gun-loading device lend themselves to being formed by molding them from suitable synthetic resin or plastic material. One such suitable material has been found to be a resin sold under the tradename "LEXAN" or A.B.F. Such material is relatively rigid but has limited flexibility and this is desirable in the present instance due to the fact that the latch members should be at least slightly flexible or bendable to effect unlatching the same and thereby, effect separation of the various components or elements of the assembly comprising the device of the invention.

Referring to FIG. 9, in which an exemplary latch 56 is illustrated on one end of one of the rods 38 or 48, there is a neck portion 58, which has limited flexibility and a tapered head 60, which terminates at its lower end in a transverse overhang 62 which is adapted to engage one surface of either the lower base member 12 or upper inlet member 14 when the latch 56 extends through one of the openings 52 in the inlet member 14 or openings 54 in the base member 12. Incidentally, the latch members 44 shown in FIG. 3 preferably is identical with latch members 56, especially for purposes of uniformity in molding such latches and the rods with which they are integral. By observing FIG. 9, it readily can be visualized that the neck portion 58 which is thinner than the tapered head 60 enables the same to be flexed sufficiently to disengage the head from the rim of one of said openings and thereby permit the opposite ends of the rods 38, which is a pivot for cylinder 10, as well as the rods 48 of the non-twistable connecting member 46, to be unlatched from said rods and separated therefrom and, similarly, the opposite ends of the rods may be disengaged from the lower base member 12, whereupon all of the major elements comprising the gun-loading device of the invention can be separated especially for cleaning purposes. Following such cleaning, they all readily may be reassembled in a very short period of time and stored, if desired, until further use is required. To effect the alignment of the latch members 56 with the respective openings referred to above, each latch member 56 has associated therewith a transversely-spaced stud-like projection 64, which is molded integrally with the rod to which it is connected and said stud, in each instance, engages an opposite wall of the hole or opening within which the latch member 56 is associated. Thus, the combined latch member 56 and stud-like projection 64 will effect centering of the end of the rod upon which the elements are formed within the holes through which said elements project.

The latch members 56 only prevent axial movement when in latched position. Further to seat the necks of the latch members 56 and the stud-like projection 64 within the respective openings in either the lower base member 12 or inlet member 14, it will be seen from FIG. 9 that the latch ends of the rods with which they are integral also are provided with an annular transverse shoulder 66 which abuts the surface of the element through which the latch neck 58 and stud 64 extend, whereby such shoulder, in conjunction with the transverse overhang 62 firmly secures each end of the various rods to the upper and lower elements between which said rods extend. Preferably, in cross-section, not shown, the neck portion 58 and stud-like projection 64 are circular and correspond to the walls of the openings in the several elements abutting opposite ends of the cylinder 10 and through which they project.

From the foregoing, it will be seen that the present invention comprises a gun-loading device composed of a limited number of different elements which are readily connected substantially without the use of tools and, similarly, readily may be disconnected especially for purposes of cleansing the components for removing any accumulated powder grains or the like and thus, permit the device to be stored between uses thereof and always ready to be used. Between uses, the several bores 16 may remain loaded with charges of powder and/or bullets or balls, especially in view of the fact that the lower base member 12 and upper inlet member 14, as shown in FIG. 3, maintain the opposite ends of the various bores 16 in closed condition. When stored, best practice would indicate that the bore of cylinder 10, which is aligned with plunger 30, would remain unloaded.

Of considerable importance in the present invention, is the non-twistable connecting member 46, which effectively prevents relative twisting of the members 12 and 14 about the axis of rod 38 which is a pivot for the cylinder 10. This arrangement, due to the nature of member 46, is completely effective to prevent such relative rotation between the elements 12 and 14.

Figure 5:
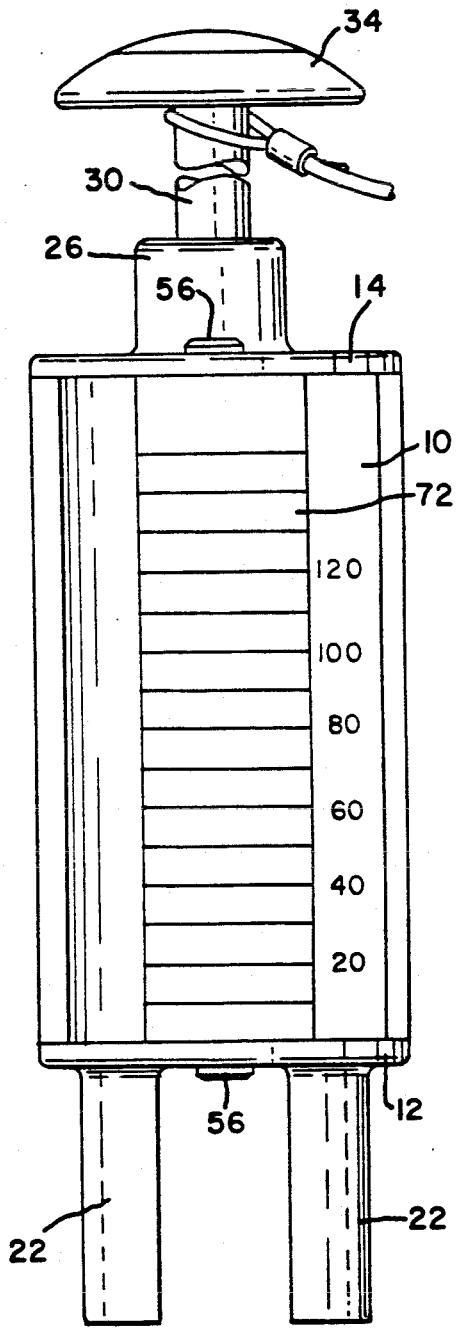
FIG. 5 is a side elevation of the device shown in FIG. 4, as seen from the right-hand side thereof.

While it is preferred that the members 12 and 14 be secured to the several rods of the device by latch means as described above, especially to assist in loading the bores with powder and ammunition, as shown in FIG. 8, the ends of rods 48, comprising connecting member 46, which engage base member 12, may be attached thereto by screws 68 which extend through bevelled holes 70 in said base member 12. Under such circumstances, the inlet member 14 may be unlatched from said rigidifying member 46 and rod 38, thus exposing the upper ends of the bores 16 for ready-loading with powder and/or bullets or balls. Also, to assist in loading the bores 16, at least the cylinder 10 may be molded from transparent resin and a scale 72 may be formed on an exterior surface of the cylinder, as shown in FIG. 5.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein:

We claim:

1. A gun-loading device operable to charge a gun with powder and/or a bullet or ball and comprising in combination, a lower base member having socket means to position said device upon the muzzle of said gun and a discharge opening alignable with said socket, a storage member having a plurality of parallel bores adapted for each to receive respectively measured charges of powder and/or a bullet or ball, said storage member being rotatably mounted upon an axis perpendicular to said base member, an upper inlet member having an opening with which said bores of said storage member are alignable and through which powder and/or a bullet or ball are introduced respectively into said bores, a plunger perpendicular to said upper inlet member and parallel to the axis of said bores and operable to push charges of powder and/or bullets or balls from said bores and through said opening in said base member and into the muzzle of a gun when the muzzle thereof is disposed in said socket means, securing means extending between said base and inlet members and operable to maintain the same respectively adjacent opposite ends of said storage member, said securing means comprising a pair of relatively short rods of similar length extending between said base and inlet members in transversely-spaced manner to each other, and another one of such rods extending through a central bore in said storage member and comprising an axis around which said storage member is rotatable successively to disposed one of said bores in axial relationship with a discharge opening in said base for receiving a charge of powder and transmit it therethrough to the muzzle of a gun when said muzzle id disposed in said socket means in said base.

2. The gun-loading device according to claim 1 in which said pair of said short rods are connected integrally to opposite edges of a web extending transversely between the same, thereby rendering said connected rods resistant to relative skewing or twisting and thus also rendering said base and inlet members resistant to twisting relative to each other when assembled with said pair of rods.

3. The gun-loading device according to claim 1 further including quick-releasable means comprising a flexible latch member on one end of said securing means, and said latch member extending through an opening in said inlet member and having a transverse securing shoulder engageable with the outer surface of said inlet member adjacent said opening.

4. The gun-loading device according to claim 1 further including quick-releasable means disposed on the opposite ends of said securing means and comprising flexible latch members extending through openings of uniform predetermined diameter respectively in said base and inlet members and each latch member having a transverse securing shoulder engageable respectively with the outer surfaces of said inlet and base members adjacent said openings to render the assembly rigid.

5. The gun-loading device according to claim 4 further characterized by the components of said device being formed by molding plastic material of limited flexibility, whereby said latch members have the required limited flexibility to render the same yieldable to a limited degree sufficient to effect separation of the elements connected by said latch members.

6. A gun-loading device comprising in combination, a base member having socket means depending therefrom and open at the outer end to receive the muzzle of a gun, a discharge opening in said base member axially aligned with said socket, a storage member comprising a cylinder provided with a plurality of parallel storage bores disposed circumferentially around a central bore, axis means extending through said central bore and secured to said base member, said storage bores being disposable sequentially in alignment with said discharge opening in said base member, an upper inlet member axially aligned with said axis means and secured thereto in overlying relation to said storage bores and comprising a closure therefor, a discharge plunger projecting from and slidable through a bearing opening in said upper inlet member and projectable through said storage bores successively to discharge charges of powder and/or a bullet. or ball from said bores into the muzzle of said gun, and a non-twistable connecting member comprising a pair of transversely-spaced relatively short rods integrally-connected to opposite edges of a web substantially equal in length to said rods and the opposite ends of said integrally-connected assembly of rods and web being connected securely to and between said base and top members to prevent said members from twisting relative to each other and thereby rendering said device rigid.

7. A gun-loading device operable to charge a gun with powder and/or a bullet or ball, said device comprising in combination, a base member adapted to be positioned over the muzzle of a barrel of a gun, and having a powder discharge opening therein axially aligned with said muzzle when positioned thereon, a rotatable storage member having a plurality of parallel powder-receiving bores spaced circumferentially therein and rotatably-supported upon said base member, a cap-like upper inlet member disposed upon the upper end of said storage member having a filling opening with which said bores successively are alignable, relatively short rod members extending between said base and inlet members to secure said storage member assembled therebetween and said storage member being rotatable around one of said rod members, a plunger vertically reciprocably-mounted on said inlet member for sequential alignment with said powder-receiving bores to effect movement of the powder charges therein through said discharge opening in said base member, and latch members on at least corresponding ends of said rod members and releasably engaging rims of openings in said base and inlet members into which ends of said rods extend to secure the aforementioned elements assembled and also permitting ready-disassembly of said elements which they connect to render said elements readily adapted to be cleaned of powder particles when disassembled by release of said latch members.

8. The gun-loading device according to claim 7 in which the ends of the rod members which engage said base member are tapped to receive screws to effect relatively permanent connection between said rod members and base member, whereby the latch members on the corresponding ends of said rod members may be actuated to release said inlet member from said rod members and separate said inlet member from said storage member and thereby expose the upper ends of said bores therein for loading said bores with charges of powder and bullets or balls.

* * * * *